US006454659B1

(12) United States Patent
Noble

(10) Patent No.: US 6,454,659 B1
(45) Date of Patent: Sep. 24, 2002

(54) KAYAKING SIMULATION DEVICE FOR CREATING A RECIRCULATING HYDRAULIC HOLE EFFECT WITHIN A RECEIVING POOL

(76) Inventor: Forrest Noble, 2670-6th St., Boulder, CO (US) 80304

( * ) Notice: Subject to any disclaimer, the term of this patent is extended or adjusted under 35 U.S.C. 154(b) by 0 days.

(21) Appl. No.: 09/594,062

(22) Filed: Jun. 14, 2000

(51) Int. Cl.[7] ..... A63G 21/18
(52) U.S. Cl. ..... 472/117; 472/128; 104/70
(58) Field of Search ..... 472/116, 117, 472/128, 129; 434/247, 254; 104/53, 69, 70; 482/51, 55, 72, 73

(56) References Cited

U.S. PATENT DOCUMENTS 617,154 A 1/1899 Gates
654,980 A 7/1900 Howard
4,905,987 A 3/1990 Frenzi
D310,717 S 9/1990 Heiligenstein et al.
RE34,407 E 10/1993 Frenzl
5,249,744 A 10/1993 Ruthenberg
5,271,692 A 12/1993 Lochtefeld
5,421,782 A 6/1995 Lochtefeld
5,667,445 A 9/1997 Lochtefeld
5,766,082 A 6/1998 Lochtefeld et al.
5,989,126 A 11/1999 Kilbert et al.
6,019,547 A * 2/2000 Hill ..... 405/79

FOREIGN PATENT DOCUMENTS

EP 0 096 216 6/1982

* cited by examiner

*Primary Examiner*—Kien T. Nguyen
(74) *Attorney, Agent, or Firm*—Emery L. Tracy

(57) ABSTRACT

A kayaking simulation device for use with a water body. The water body has a water surface. The kayaking simulation device comprises a hydraulic hole mechanism for introducing a predetermined amount of water into the water body and creating a hydraulic hole in the water surface of the water body.

24 Claims, 2 Drawing Sheets

KAYAKING SIMULATION DEVICE FOR CREATING A RECIRCULATING HYDRAULIC HOLE EFFECT WITHIN A RECEIVING POOL

BACKGROUND OF THE INVENTION

1. Field of the Invention

This invention relates generally to a kayaking simulation device for allowing a kayaker to practice and perform therein and, more particularly, it relates to a kayaking simulation device which creates a recirculating hydraulic "hole" effect within a receiving pool for allowing a kayaker to perform specialized maneuvers and procedures within the recirculating hydraulic hole.

2. Description of the Prior Art

The kayak, originally designed by the Inuit of northern Canada as a fast and seaworthy hunting craft for the Arctic waters, has become a popular recreational boat for water enthusiasts. The kayak has also branched into other forms of boats such as the C-1 (or decked canoes). Today, many kayakers utilize the kayak on whitewater rivers around the world. Many equipment and technical advance have been made since the early 1980's in the field of whitewater kayaking. At the same time, the average kayak paddler is attempting more challenging rivers and tries to execute more technical whitewater acrobatic maneuvers, than ever before.

At certain times along the river, a phenomena can be created by obstacles, such as rocks or boulders, in the river which causes the water flowing over the obstacle to recirculate back toward the obstacle creating a "hole". The holes have such a powerful recirculating effect on the water that most kayakers have avoided these areas due to the high possibility of injury and drowning. As technology and kayakingskills have improved over the years, so has the desire to seek out and "play" in these river formations. In fact, today, there is an entire discipline of kayaking devoted solely to riding these hydraulic holes called Rodeo Boating.

Unfortunately, many of the hydraulic holes are generally located somewhere on the river where access is difficult for anyone not in a river vehicle such as a kayak or a raft. This limits the large contests and events to hydraulic holes which happen to be located near or adjacent a road with good access. While this dilemma has attempted to be solved by creating man made water park sections along rivers with easy access and a well formed man made hydraulic, the water parks are still limited to the forces of nature such as winter, darkness, low water levels in dry summers, flood levels in the spring, etc. Furthermore, it is also very difficult for amateur kayak paddlers to practice and learn the skills necessary on a river to maintain safety and develop their skills.

Accordingly, there exists a need for a kayaking simulation device which creates a hydraulic hole effect within a receiving pool similar to a hydraulic hole found on whitewater rivers. Additionally, a need exists for a kayaking simulation device for creating a hydraulic hole effect within a receiving pool which can be constructed and operated away from a natural whitewater river. Furthermore, there exists a need for a kayaking simulation device for creating a hydraulic hole effect within a receiving pool which allows a kayaker to compete or practice rodeo kayaking maneuvers regardless of weather, natural, and/or environmental conditions.

SUMMARY

The present invention is a kayaking simulation device for use with a water body. The water body has a water surface.

The kayaking simulation device comprises a hydraulic hole mechanism for introducing a predetermined amount of water into the water body and creating a hydraulic hole in the water surface of the water body.

The present invention additionally includes an assembly for providing a kayaking ride in a water-filled receiving pool having a water surface. The assembly comprises direction means for directing water from a first level to a second level creating a hydraulic hole in the water surface of the receiving pool. The first level is elevated relative to the second level. Recirculating means are positioned beneath the water surface for guiding at least a portion of the directed water back into the hydraulic hole.

The present invention further includes a method for creating a hydraulic hole effect in a surface of a body of water. The method comprises directing water into the water surface of the water body sufficient to create a hydraulic hole in the water surface and recirculating the water within the hydraulic hole.

DETAILED DESCRIPTION OF THE PREFERRED EMBODIMENTS

Figure 1:
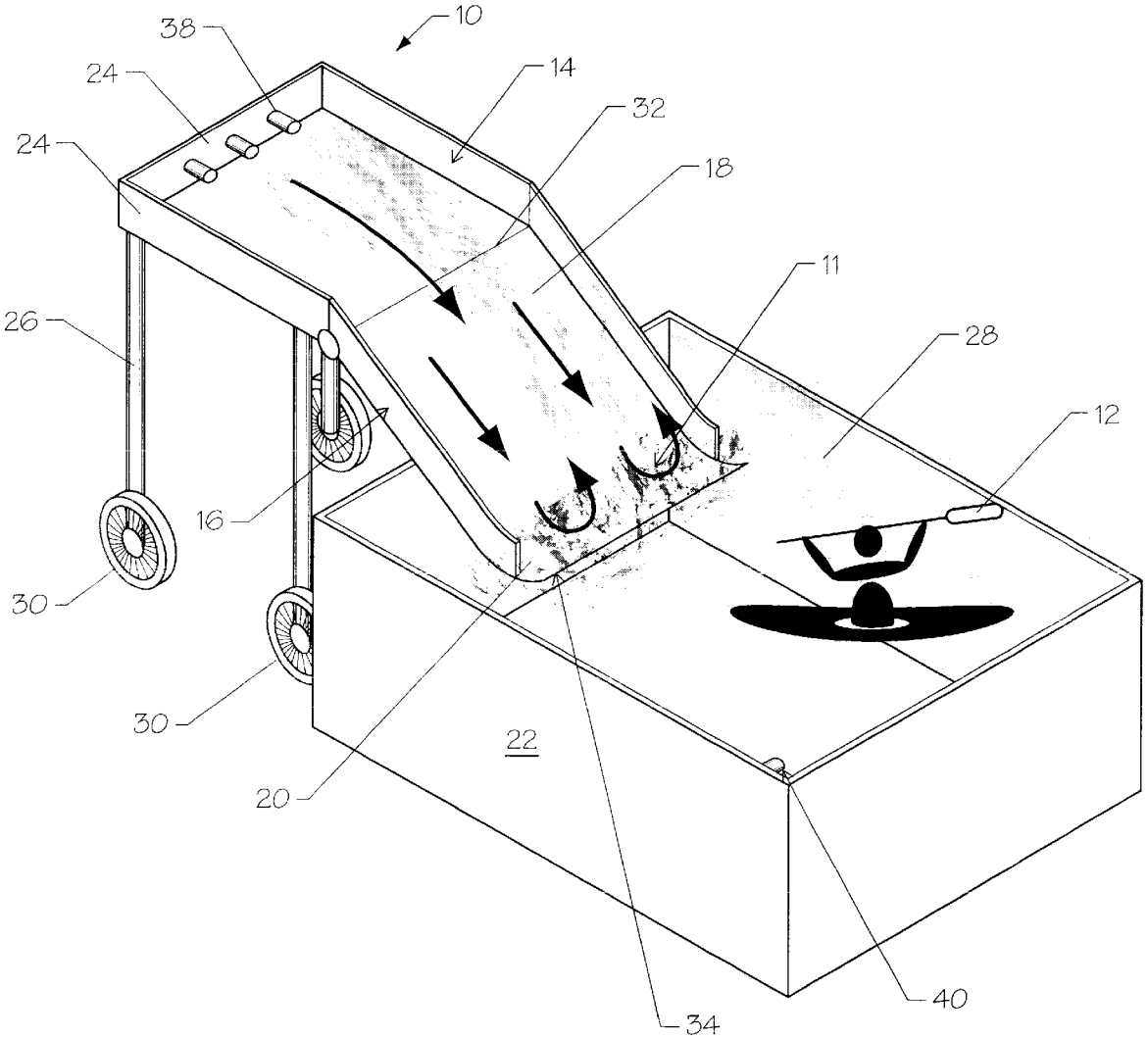
FIG. 1 is a perspective view illustrating a kayaking simulation device for creating a hydraulic hole effect in a receiving pool, constructed in accordance with the present invention, which is portable between receiving pools. The kayaking simulation device of the present invention can also be sculpted from cement or other materials to create the same effect in a permanent fashion without the portability.
Figure 2:
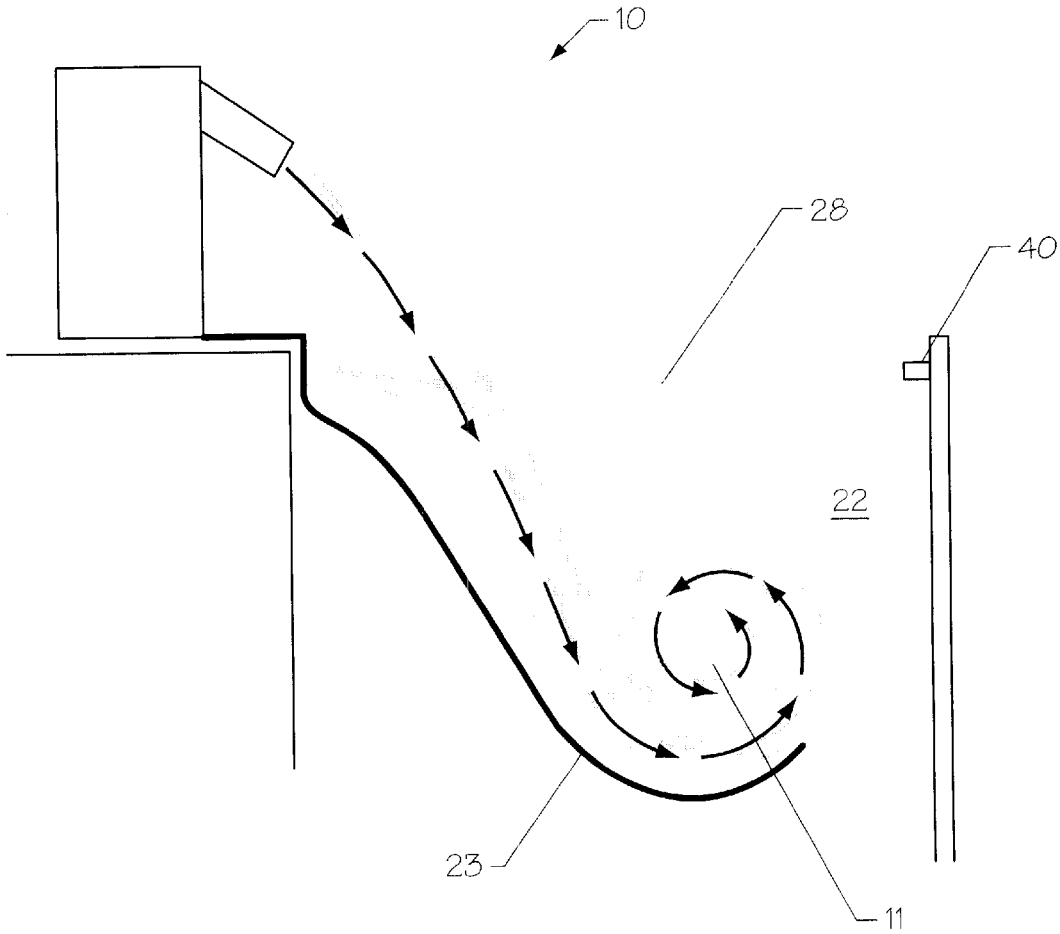
FIG. 2 is an elevational side view illustrating another embodiment of the kayaking simulation device for creating a hydraulic hole effect in a receiving pool, constructed in accordance with the present invention.

As illustrated in FIGS. 1 and 2, the present invention is a kayaking simulation device, indicated generally at 10, for creating a hydraulic hole 11 for use by kayakers 12 for rodeo kayaking maneuvers during competition events and practice. The kayaking simulation device 10 of the present invention provides an artificial environment for simulating a hydraulic hole effect 11 typically found on inaccessible whitewater rivers thereby allowing a kayaker 12 to perform maneuvers therein without concern for weather, natural, and/or environmental conditions.

While the term "kayak" will be used for ease of description herein, a person skilled in the art will understand that the present invention is not limited to only kayaks. Other forms of whitewater vehicles including, but not limited to, decked canoes, bodyboards, open canoes, rubber duckies, rafts, etc., are within the scope of the present invention.

The kayaking simulation device 10 of the present invention includes an elevated platform 14, an inclined slide 16 having a connected end 18 and a submerged end 20, and a receiving pool 22 below the elevated platform 14 with the connected end 18 of the inclined slide 16 being pivotally connected to the elevated platform 14 and the submerged end 20 of the inclined slide 16 extending a predetermined distance into the receiving pool 22. The elevated platform 14 and inclined slide 16 can be constructed of any type of material including, but not limited to, wood, steel, aluminum, concrete, plastic, Fiberglass, ceramic, etc. In addition, a person skilled in the art will understand that the elevated platform 14 can actually be a different elevated level within a building (not shown) or on a hilltop or hillside (not shown) so long as the elevated platform 14 is elevated above the receiving pool 22 and the submerged end 20 of the inclined slide 16 extends into or nearingly adjacent the receiving pool 22.

As illustrated in FIG. 2, through the use of water jets, the elevated platform 14 is not necessary for use and enjoyment of the present invention. The waterjets are sufficient to cause a hydraulic hole to be created in the receiving pool 22. An insert 23 can be placed in the receiving pool 22 to promote the creation of the hydraulic hole. The insert 23 can be constructed from any type of suitable material including, but not limited to, plastic, Fiberglass, concrete, metal, etc. It should be noted that different shapes and depths of the insert 23 can change the recirculating effect at the surface level of the hydraulic hole.

The elevated platform 14 of the kayak simulation device 10 of the present invention additionally includes a plurality of platform side walls 24. The platform side walls 24 can be constructed to allow a predetermined amount of water to remain upon the elevated platform 14 sufficient to float a kayaker 12 within his or her kayak upon the elevated platform 14. Furthermore, when water jets are not being used, the amount of water must be sufficient to create the hydraulic hole 11 within the receiving pool 22 at the submerged end 20 of the inclined slide 16. Description of the creation of the hydraulic hole 11 will be described in further detail below.

Preferably, the elevated platform 14 includes a support frame 26 for supporting the elevated platform 14 at a predetermined height above a water surface 28 of the receiving pool 22. Preferably, the height of the elevated platform 14 is between approximately three (3') feet and approximately fifteen (15') feet above the surface 28 of the receiving pool 22. It is within the scope of the present invention, however, to elevate the elevated platform 14 less than approximately three (3') feet and greater than approximately fifteen (15') feet above the water surface 28 of the receiving pool 22 so long as a hydraulic hole 11 is created in the water surface 28, as will discussed in further detail below.

Furthermore, the inventor of the present application has discovered that an elevated platform 14 with a width of approximately ten (10') feet and a length of approximately ten (10') feet is sufficient to allow a kayaker 12 to enter his or her kayak, maneuver into position upon the water within the elevated platform 14, and proceed in a desired manner down the inclined slide 16 toward the hydraulic hole formed in the water surface 28 of the receiving pool 22. It should be noted, however, that an elevated platform 14 having a width greater than or less than approximately ten (10') feet and/or a length of greater than or less than approximately ten (10') feet is within the scope of the present invention.

The elevated platform 14 of the kayak simulation device 10 can be mounted on wheels 30, or can be otherwise mobile, to allow the elevated platform 14 to be moved to various desired locations including indoors and/or adjacent an existing swimming pool, river, lake, or other container of water. In the latter instance, the existing swimming pool or lake can be used as the receiving pool 22. In the alternative, the elevated platform 14 can be formed from concrete or other materials and permanently or semi-permanently constructed to the ground in an outdoor environment and/or within a building. Preferably, the receiving pool 22 has a depth of approximately ten (10') feet which has been found to be sufficient for kayakers 12 to perform rodeo maneuvers within the hydraulic hole 11 created therein. It should be noted, however, that it is within the scope of the present invention to have a receiving pool 22 with a depth of greater than or less than ten (10') feet.

As discussed above, the connected end 18 of the inclined slide 16 may be pivotally connected to an edge 32 of the elevated platform 14. The inclined slide 16 is adjustable to provide various angles of incline, i.e., between approximately zero (0°) degrees and approximately ninety (90°) degrees between the inclined slide 16 and the elevated platform 14. Furthermore, as discussed above, the submerged end 20 of the inclined slide 16 extends a predetermined distance, i.e., between approximately three (3') feet and approximately ten (10') feet, into the receiving pool 22. The actual extent of the inclined slide 16 into the receiving pool 22 is determined by the amount of water traveling down the inclined slide 16 from the elevated platform 14 and the size of the hydraulic hole 11 desired.

The inclined slide 16 of the kayak simulation device 10 of the present invention includes a curved lip portion 34 formed on the submerged end 20 of the inclined slide 16 to assist in creating the hydraulic hole 11 in the water surface 28 of the receiving pool 22. As the water travels or otherwise flows down the inclined slide 16 from the elevated platform 14 to the receiving pool 22, the traveling water hits the water surface 28 within the receiving pool and penetrates the water surface 28 creating a hydraulic hole. The traveling water continues going deeper within the receiving pool 22 until the traveling water reaches the lip portion 34 of the inclined slide 16. The lip portion 34 causes the traveling water to rise to the water surface 28 of the receiving pool 22. While some of the traveling water escapes and travels in a direction generally away from the inclined slide 16, a majority of the traveling water falls back into the hydraulic hole 1 towards the inclined slide 16 thereby creating a reversal or hydraulic. The water continues to recirculate in a substantially circular pattern, being recharged by the additional water flowing down the inclined slide 16, thereby furthering the hydraulic hole 11 and the hydraulic hole effect.

The inclined slide 16 may also include a pair of adjustable side walls 36 extending from the connected end 18 of the inclined slide 16 to the submerged end 20 of the inclined slide 16 to promote the water traveling down the inclined slide 16 to remain on a direct course into the water surface 28 of the receiving pool 22 and over the lip portion 34 of the inclined slide 16. The side walls 36 of the inclined slide 16 are preferably adjustable to various heights depending on the amount of water traveling down the inclined slide 16 and the desires of the user. Furthermore, while the side walls 36 have been illustrated as being substantially parallel to one another, it is within the scope of the present invention to have the side walls 36 angled to become narrower as the inclined slide 16 extends toward the receiving pool 22. The actual relative angle of the side walls 36 can be adjusted depending on the desires and needs of the user to increase or decrease the flow.

The kayak simulation device 10 of the present invention further includes means 38 for introducing water upon the elevated platform 14 (FIG. 1) or into the receiving pool 22 (FIG. 2) and creating the hydraulic hole 11 in the water surface 28 of the receiving pool 22. The means 38 includes water pumps and/or jets which direct water into the elevated platform 14. The water then flows down the inclined slide 16 toward the receiving pool 22, through the water surface 28, across the lip portion 34, and, with at least some of the water, back into the hydraulic hole 11 created. Preferably, the waterflow through the water pumps and/or jets is adjustable with the optimum amount of water flowing down the inclined slide 16 into the receiving pool 22. The inventor of the present application has found that a natural hole created on a natural river with approximately three hundred (300 cfs) cubic feet per second to approximately one thousand (1000 cfs) cubic feet per second can be simulated with either recirculating this amount of water down the inclined slide 16 using large water pumps or gaining the similar effect with less water amounts through the use of jets or high pressure pumps, i.e., a fire hose. Of course, amounts less than three hundred (300 cfs) cubic feet per second and greater than one thousand (1000 cfs) cubic feet per second are within the scope of the present invention.

In addition to the water pumps and/or jets on elevated platform, a plurality of jets 40 can be installed in the receiving pool 22 for directing a waterflow in a direction generally back toward the inclined slide 16. The receiving pool jets 40 assist in creating the recirculation effect of the hydraulic hole 11 within the receiving pool 22 thereby reducing the amount of water necessary flowing from the elevated platform 14 and down the inclined slide 16.

In an attempt to conserve water, the water pumps and/or jets can actually utilize recirculated water drawn from the receiving pool 22. For instance, the water directed through the water pumps and/or jets can be drawn from the receiving pool in a continuous recycled manner.

In use, the kayaker 12 or other user can utilize the kayak simulation device 10 for performing numerous kayaking maneuvers in a variety of manners. First, the kayaker 12 can enter the hydraulic hole 11 created by the kayak simulation device 10 by beginning upon the elevated platform 14 and traveling down the inclined slide 16 into the receiving pool 22 and the hydraulic hole 11 formed therein in the direction of the water flow. Second, as illustrated in FIG. 1, the kayaker can begin within the receiving pool 22 and enter the hydraulic hole 11 created by the kayak simulation device 10 from within the receiving pool 22 without first traveling down the inclined slide 16.

The kayak simulation device 10 of the present invention offers many advantages over natural environmental hydraulic holes. For instance, the kayak simulation device can be turned off at any time thereby allowing a kayak paddler 12 to test and push their abilities further under artificial conditions without being positioned in a life threatening drowning situation. For instance, in a natural environment, a kayaker 12 must exercise a certain level of caution or risk his or her life. The kayak simulation device 10 increases the safety factors when maneuvering within hydraulic holes.

In addition, with the kayak simulation device 10, the amount of water traveling down the inclined slide 16, the angle of the inclined slide 16, the width of the inclined slide 16, the depth of the receiving pool 22, and the formation of the lip portion 34 can be adjusted to create a custom hydraulic hole effect to each users specific desires. This flexibility allows users of all skill levels to participate and enjoy the kayak simulation device 10 under controlled and safe conditions.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A kayaking simulation device for use with a water body, the water body having a water surface, the kayaking simulation device comprising:

hydraulic hole means for introducing a predetermined amount of water into the water body and directing at least a portion of the introduced water within the water body in a general direction back toward the point of water introduction, the directed water being maintained within the water body thereby creating a hydraulic hole in the water surface of the water body.

2. The kayaking simulation device of claim 1 wherein the hydraulic hole means includes at least one water jet positioned above a top water surface of the water body for directing water into the water body.

3. The kayaking simulation device of claim 1 wherein the hydraulic hole means includes a platform positioned a predetermined distance above the water body and an inclined slide connected to the platform and extending toward the water surface of the water body.

4. The kayaking simulation device of claim 3 and further comprising:

a portable frame for supporting the platform a predetermined distance above the surface of the water body; and at least one wheel mounted to the portable frame for promoting movement of the platform and the inclined slide.

5. The kayaking simulation device of claim 3 wherein the platform includes a plurality of side walls, the side walls maintaining a predetermined amount of water upon the platform subsequent to the water flowing down the inclined slide.

6. The kayaking simulation device of claim 3 wherein the inclined slide is pivotally and adjustably connected to the platform.

7. The kayaking simulation device of claim 3 wherein the inclined slide extends a predetermined distance into the water body.

8. The kayaking simulation device of claim 1 and further comprising:

an insert positioned within the water body for promoting creation of the hydraulic hole therein, the insert having a rounded portion curving toward the surface of the water body.

9. The kayaking simulation device of claim 1 wherein the water body is selected from the group consisting of a receiving pool, a lake, a swimming pool, and a river.

10. An assembly for providing a kayaking ride in a water-filled receiving pool, the receiving pool having a water surface, the assembly comprising:

direction means for directing water from a first level to a second level creating a hydraulic hole in the water surface of the receiving pool, the first level being elevated relative to the second level; and recirculating means positioned beneath the water surface for directing at least a portion of the introduced water in a general direction back toward the point of water introduction directly into the hydraulic hole, the directed water being maintained within the water body.

11. The assembly of claim 10 wherein the direction means includes:

a platform positioned a predetermined distance above the receiving pool; and an inclined slide connected to the platform and extending into the water surface of the receiving pool.

12. The assembly of claim 11 wherein the platform includes a plurality of side walls, the side walls maintaining a predetermined amount of water upon the platform subsequent to the water flowing down the inclined slide.

13. The assembly of claim 11 wherein the inclined slide is pivotally connected to the platform, and further comprising:

adjusting means for adjusting the angle of the inclined slide relative to the platform.

14. The assembly of claim 10 wherein the recirculating means includes a curved lip portion beneath the water surface of the receiving pool, the curved lip portion curving in a direction generally toward the water surface of the receiving pool thereby recirculating at least a portion of the water back into the hydraulic hole.

15. A method for creating a hydraulic hole effect in a water surface of a water body, the method comprising:

directing water into the water surface of the water body sufficient to create a hydraulic hole in the water surface;

recirculating the water within the hydraulic hole providing an elevated platform;

elevating the platform a predetermined distance above the body of water;

providing an inclined slide;

connecting the inclined slide to the platform;

extending the inclined slide toward and into the surface of the body of water;

directing a predetermined amount of water down the inclined slide; and creating a hydraulic hole effect in the surface of the body of water.

16. The method of claim 15 and further comprising:

pivotally connecting the inclined slide to the platform; and adjusting the angle of the inclined slide relative to the platform.

17. The method of claim 15 and further comprising:

providing an insert for recirculating the water within the hydraulic hole in a direction generally back toward the hydraulic hole.

18. A kayaking simulation device for use with a water body, the water body having a water surface, the kayaking simulation device comprising:

hydraulic hole means for introducing a predetermined amount of water into the water body and creating a hydraulic hole in the water surface of the water body;

a platform positioned a predetermined distance above the water body;

an inclined slide connected to the platform and extending toward the water surface of the water body;

a portable frame for supporting the platform a predetermined distance above the surface of the water body; and at least one wheel mounted to the portable frame for promoting movement of the platform and the inclined slide.

19. A kayaking simulation device for use with a water body, the water body having a water surface, the kayaking simulation device comprising:

hydraulic hole means for introducing a predetermined amount of water into the water body and creating a hydraulic hole in the water surface of the water body;

a platform positioned a predetermined distance above the water body; and inclined slide connected to the platform and extending toward the water surface of the water body;

wherein the inclined slide is pivotally and adjustably connected to the platform.

20. A kayaking simulation device for use with a water body, the water body having a water surface, the kayaking simulation device comprising:

hydraulic hole means for introducing a predetermined amount of water into the water body and creating a hydraulic hole in the water surface of the water body;

an insert positioned within the water body for directing the water in a direction generally toward the surface of the water body thereby recirculating at least a portion of the water back into the hydraulic hole and promoting creation of the hydraulic hole therein, the insert having a rounded portion curving toward the surface of the water body.

21. An assembly for providing a kayaking ride in a water-filled receiving pool, the receiving pool having a water surface, the assembly comprising:

direction means for directing water from a first level to a second level creating a hydraulic hole in the water surface of the receiving pool, the first level being elevated relative to the second level;

recirculating means positioned beneath the water surface for guiding at least a portion of the directed water back into the hydraulic hole;

a platform positioned a predetermined distance above the receiving pool; and an inclined slide connected to the platform and extending into the water surface of the receiving pool; and adjusting means for adjusting the angle of the inclined slide relative to the platform.

22. An assembly for providing a kayaking ride in a water-filled receiving pool, the receiving pool having a water surface, the assembly comprising:

direction means for directing water from a first level to a second level creating a hydraulic hole in the water surface of the receiving pool, the first level being elevated relative to the second level; and recirculating means positioned beneath the water surface for guiding at least a portion of the directed water back into the hydraulic hole;

wherein the recirculating means includes a curved lip portion beneath the water surface of the receiving pool, the curved lip portion curving in a direction generally toward the water surface of the receiving pool thereby recirculating at least a portion of the water back into the hydraulic hole.

23. A method for creating a hydraulic hole effect in a water surface of a water body, the method comprising:

providing an elevated platform;

elevating the platform a predetermined distance above the body of water;

providing an inclined slide;

pivotally connecting the inclined slide to the platform;

adjusting the angle of the inclined slide relative to the platform;

extending the inclined slide toward the surface of the body of water;

directing a predetermined amount of water down the inclined slide; and creating a hydraulic hole effect in the surface of the body of water.

24. A method for creating a hydraulic hole effect in a water surface of a water body, the method comprising:

directing water into the water surface of the water body sufficient to create a hydraulic hole in the water surface;

recirculating the water within the hydraulic hole; and providing an insert for recirculating the water within the hydraulic hole in a direction generally back toward the hydraulic hole.

* * * * *